US009280089B2

(12) United States Patent
Kuramashi

(10) Patent No.: US 9,280,089 B2
(45) Date of Patent: Mar. 8, 2016

(54) DEVELOPER CONVEYING APPARATUS, DEVELOPING DEVICE, AND IMAGE FORMING APPARATUS

(71) Applicant: Kyocera Document Solutions Inc., Osaka (JP)

(72) Inventor: Koji Kuramashi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/736,288

(22) Filed: Jun. 11, 2015

(65) Prior Publication Data

US 2015/0362862 A1 Dec. 17, 2015

(30) Foreign Application Priority Data

Jun. 11, 2014 (JP) ..... 2014-120855

(51) Int. Cl.
*G03G 15/08* (2006.01)

(52) U.S. Cl.
CPC ..... *G03G 15/0865* (2013.01); *G03G 15/0891* (2013.01)

(58) Field of Classification Search
CPC ..... G03G 15/0822; G03G 15/0856; G03G 15/0865; G03G 15/0889; G03G 15/0891; G03G 15/0893
See application file for complete search history.

(56) References Cited

U.S. PATENT DOCUMENTS 9,146,501 B2 * 9/2015 Kikuchi et al. .... G03G 15/0889

FOREIGN PATENT DOCUMENTS

JP H04-090576 A 3/1992

* cited by examiner

*Primary Examiner* — William J Royer
(74) *Attorney, Agent, or Firm* — James W. Judge

(57) ABSTRACT

A developer conveying apparatus includes a developer housing portion, a first spiral feeder, a second spiral feeder, a driving unit, an operation control unit, and a sensor. The first spiral feeder and the second spiral feeder each include a hollow spiral member and rib members. The hollow spiral member is spirally formed and internally has a space. The rib members run in a first direction and bridge spiral pieces constituting the spiral member. The operation control unit causes: the driving unit to change the rotation speed of the first spiral feeder and the second spiral feeder according to a printing linear speed of an image forming part; and the driving unit to change a rotational phase difference between the first spiral feeder and the second spiral feeder referring positions of the rib members to a predetermined rotational phase difference according to the changed rotation speed.

8 Claims, 11 Drawing Sheets

DEVELOPER CONVEYING APPARATUS, DEVELOPING DEVICE, AND IMAGE FORMING APPARATUS

INCORPORATION BY REFERENCE

This application is based upon, and claims the benefit of priority from, corresponding Japanese Patent Application No. 2014-120855 filed in the Japan Patent Office on Jun. 11, 2014, the entire contents of which are incorporated herein by reference.

BACKGROUND

Unless otherwise indicated herein, the description in this section is not prior art to the claims in this application and is not admitted to be prior art by inclusion in this section.

To achieve excellent development property when forming an image by electrophotographic method, it is necessary to keep a toner amount in a developer housed in a developer housing portion within an appropriate range. In view of this, general developer housing portions internally include a stirring unit and a sensor. The stirring unit stirs the developer to prevent the developer from accumulating and attaching. The sensor measures the toner amount of the developer. When the toner amount measured by the sensor reaches to equal to or less than a predetermined replenishment threshold, replenishing the toner in the developer housing portion ensures keeping the toner amount in the developer within the appropriate range.

SUMMARY

A developer conveying apparatus according to one aspect of the disclosure includes a developer housing portion, a first spiral feeder, a second spiral feeder, a driving unit, an operation control unit, and a sensor. The developer housing portion includes a first housing portion and a second housing portion housing the developer. The developer housing portion forms communicating ports at both end portions in a longitudinal direction of a partition wall partitioning the first housing portion and the second housing portion. The developer is movable between the first housing portion and the second housing portion through the communicating ports. The first spiral feeder is rotatably located in the first housing portion. The first spiral feeder conveys the developer housed in the first housing portion in a first direction along the longitudinal direction. The second spiral feeder is rotatably located in the second housing portion. The second spiral feeder conveys the developer housed in the second housing portion in a second direction opposite direction from the first direction. The driving unit rotatably drives the first spiral feeder and the second spiral feeder at an identical rotation speed. The operation control unit controls a rotary drive operation by the driving unit. The sensor is located at a periphery position of the communicating port in the developer housing portion to measure a toner amount of the developer housed in the developer housing portion. The first spiral feeder and the second spiral feeder each include a hollow spiral member and rib members. The hollow spiral member is spirally formed and internally has a space. The rib members run in the first direction and bridge spiral pieces constituting the spiral member. The operation control unit causes: the driving unit to change the rotation speed of the first spiral feeder and the second spiral feeder according to a printing linear speed of an image forming part, the image forming part being a supply destination of the developer housed in the developer housing portion; and the driving unit to change a rotational phase difference between the first spiral feeder and the second spiral feeder referring positions of the rib members to a predetermined rotational phase difference according to the changed rotation speed.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
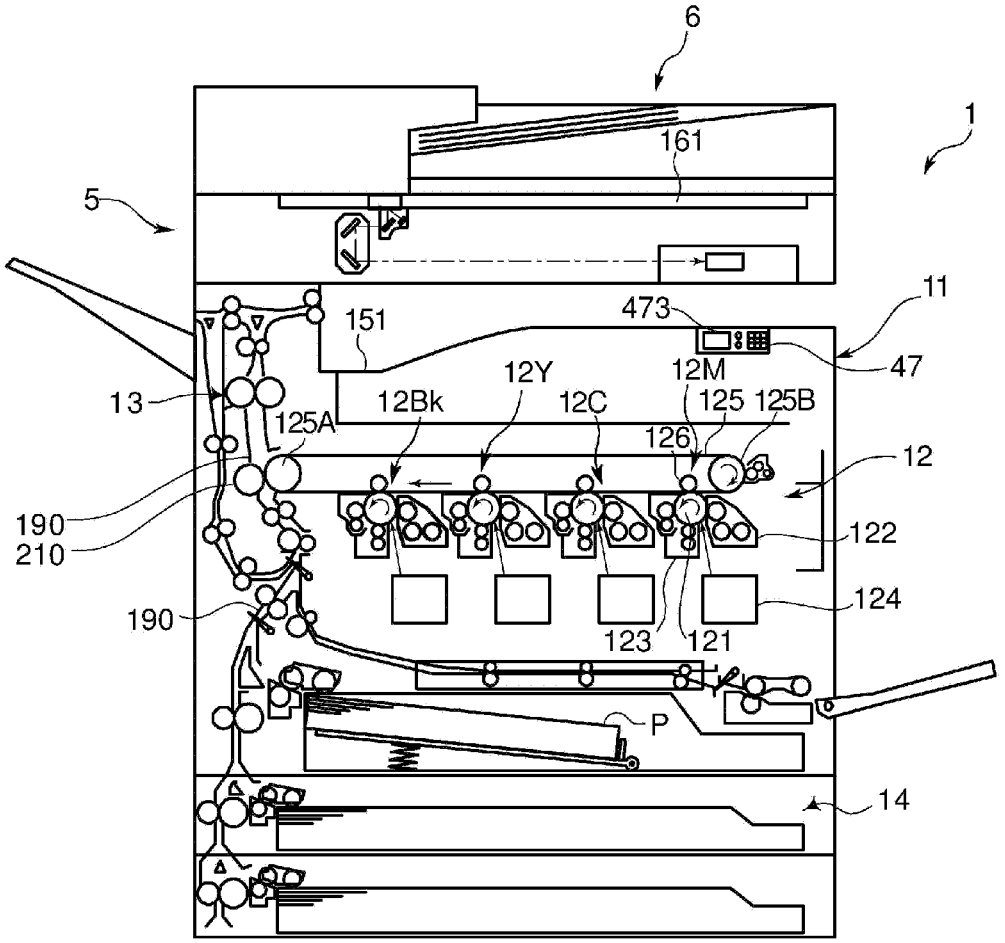
FIG. 1 illustrates a cross section of a structure of an image forming apparatus with a developing device according to one embodiment of the disclosure from a front view.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

The following describes a developer conveying apparatus 50, a developing device 122, and an image forming apparatus 1 according to one embodiment of the disclosure with reference to the drawings. FIG. 1 illustrates a front cross-section of a structure of an image forming apparatus 1 with a developing device 122 according to one embodiment of the disclosure from a front view.

The image forming apparatus 1 is a multi-functional peripheral with a plurality of functions, such as a copy function, a printer function, a scanner function, and a facsimile function. The image forming apparatus 1 includes an operation unit 47, image forming units 12, a fixing unit 13, a paper sheet feeder 14, a document feeding unit 6, a document reading unit 5, and a similar unit in an apparatus main body 11.

When the image forming apparatus 1 performs a document reading operation, the following processes are performed. The document reading unit 5 optically reads a document fed by the document feeding unit 6 or an image of the document placed on a document placing glass 161 and thus generates image data. The image data generated by the document reading unit 5 is stored in a built-in HDD, a network-connected computer, or a similar medium.

In the image forming operation by the image forming apparatus 1, the image forming units 12 forms a toner image on a recording sheet P fed from the paper sheet feeder 14, based on the image data created by the document reading operation, the image data stored in the built-in HDD, or similar data.

An image forming unit 12M for magenta, an image forming unit 12C for cyan, an image forming unit 12Y for yellow, and an image forming unit 12Bk for black of the image forming units 12 each include a photoreceptor drum (image carrier) 121, the developing device 122, a charging apparatus 123, an exposure apparatus 124, and a primary transfer roller 126.

For color printing, the image forming units 12M, 12C, 12Y, and 12Bk form a toner image on the photoreceptor drum 121 based on images formed of respective color components constituting the image data through processes of charging, exposure, and development. Then, the primary transfer roller 126 causes the toner images to be transferred on an intermediate transfer belt 125 stretched by a drive roller 125A and a driven roller 125B.

The toner images with the respective colors to be transferred on the intermediate transfer belt 125 are superimposed on the intermediate transfer belt 125 while the transfer timing is adjusted, thus forming a color toner image. A secondary transfer roller 210 causes the color toner image formed on the surface of the intermediate transfer belt 125 to be transferred on the recording sheet P conveyed from the paper sheet feeder 14 to a conveyance path 190 at a nip area with the drive roller 125A sandwiching the intermediate transfer belt 125. Thereafter, the fixing unit 13 causes the toner image on the recording sheet P to be fixed on the recording sheet P by heat fixing. The color-image-formed recording sheet P on which the fixing process has been completed is discharged to a discharge tray 151.

Figure 2:
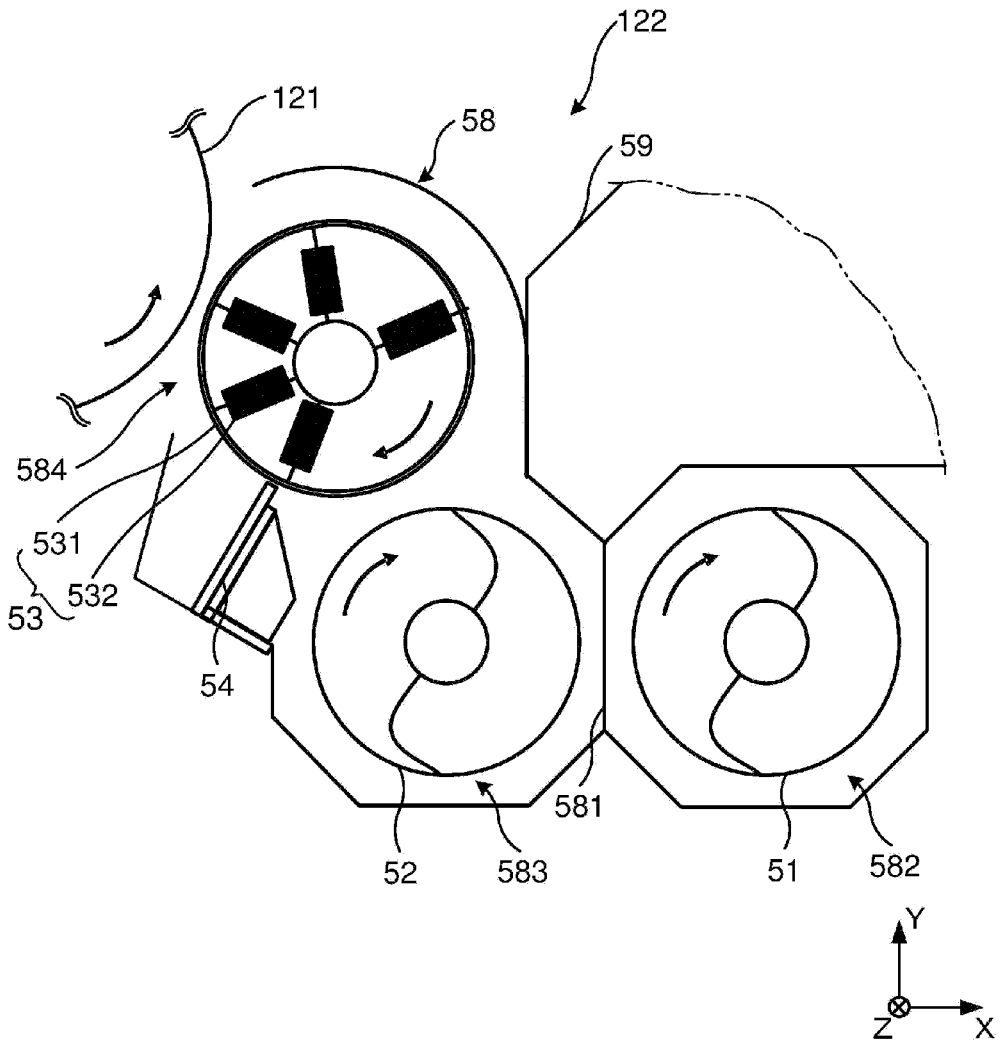
FIG. 2 illustrates a cross section of the structure of the developing device according to the one embodiment.
Figure 3:
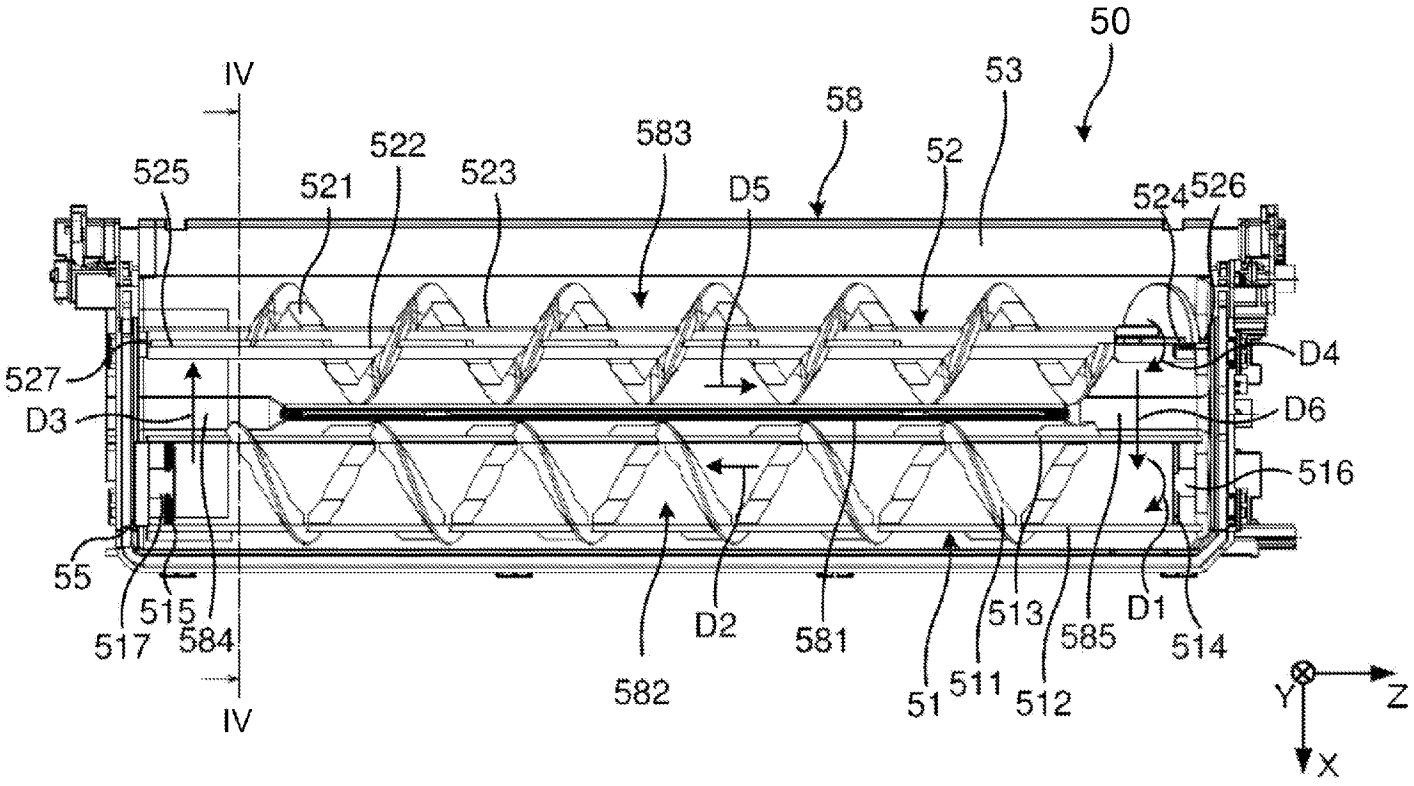
FIG. 3 illustrates a plan view of the structure of a developer conveying apparatus according to the one embodiment.

FIG. 2 illustrates a cross-section of the structure of the developing device 122 according to the one embodiment. FIG. 3 illustrates the structure of a developer conveying apparatus 50 according to the one embodiment in a plane. FIG. 3 illustrates a state where a bottom wall is removed from a housing 58 and the housing 58 is viewed from the Y direction.

As illustrated in the drawing, the developing device 122 includes a first spiral feeder 51, a second spiral feeder 52, a developing roller (developer carrier) 53, a regulating blade 54, and a toner amount measuring sensor 55 in the housing (developer housing portion) 58.

The housing 58 serves as a housing portion that houses the developer. In this embodiment, the housing 58 houses a one-component developer containing magnetic toner.

At the inside of the housing 58, a partition wall 581 is internally formed. This separates the inside of the housing 58 into a first housing portion 582 and a second housing portion 583. At both the end portions of the partition wall 581 in a longitudinal direction (Z direction), a first communicating port (first transferring port) 584 and a second communicating port (second transferring port) 585 are provided in an open manner. These first communicating port 584 and second communicating port 585 communicate the first housing portion 582 and the second housing portion 583 with one another.

At the first housing portion 582, a developer replenishing port (not illustrated) is provided in an open manner. Under a control by an operation control unit 101 (see FIG. 5), which will be described later, a shutter located at this developer replenishing port opens and closes to replenish the developer from a developer container 59 to the first housing portion 582. To the first housing portion 582, the first spiral feeder 51 is rotatably journaled. The first spiral feeder 51 is rotatably driven by a spiral feeder driving unit 72 (see FIG. 5), which will be described later, in an arrow D1 direction. This stirs the developer replenished from the developer container 59 to the first housing portion 582 and conveys the developer in a conveyance direction D2 (arrow). The developer conveyed in the conveyance direction D2 direction passes through the first communicating port 584 (arrow D3) and moves to the second housing portion 583.

To the second housing portion 583, the second spiral feeder 52 is rotatably journaled. The second spiral feeder 52 is rotatably driven by the spiral feeder driving unit 72 in an arrow D4 direction. This conveys the developer housed in the second housing portion 583 in a conveyance direction D5 (arrow). The developer conveyed in the conveyance direction D5 direction passes through the second communicating port 585 (arrow D6) and moves to the first housing portion 582. The first spiral feeder 51 and the second spiral feeder 52 are set such that the conveyance direction D2 of the developer in the first housing portion 582 and the conveyance direction D5 of the developer in the second housing portion 583 are opposite directions. This circulatory conveys the developer between the first housing portion 582 and the second housing portion 583.

The developing roller 53 includes a sleeve 531 made of a non-magnetic material and a stationary magnet 532. The stationary magnet 532 has a plurality of magnetic poles (five poles in this embodiment) located inside the sleeve 531. The developing roller 53 is rotatably journaled to the housing 58 such that a part of the developing roller 53 is exposed to the first communicating port 584 of the housing 58. In this state, the developing roller 53 is opposed to the photoreceptor drum 121. The developing roller 53 pumps up the developer conveyed with the first spiral feeder 51 and the second spiral feeder 52 by the magnetic force of the stationary magnet 532.

The regulating blade 54 regulates the developer carried on the circumference surface of the developing roller 53 to a predetermined layer thickness. Providing a predetermined distance with the developing roller 53, the regulating blade 54 is supported by the housing 58. The developer whose layer thickness is regulated by the regulating blade 54 is drawn by an electrostatic latent image formed on the circumference surface of the photoreceptor drum 121. Then, the developer moves to a developable area on the circumference surface of the photoreceptor drum 121.

The toner amount measuring sensor 55 is a so-called current sensor. The toner amount measuring sensor 55 is located at the first communicating port 584 in the housing 58 or at a periphery position of the second communicating port 585. In the example illustrated in FIG. 3, the toner amount measuring sensor 55 is located at a region opposed to a second connecting portion 515 on the wall surface of the first housing portion 582. The toner amount measuring sensor 55 outputs a voltage value corresponding to pressure given to the wall surface of the first housing portion 582 with the developer to detect an amount of developer housed in the housing 58.

Figure 4:
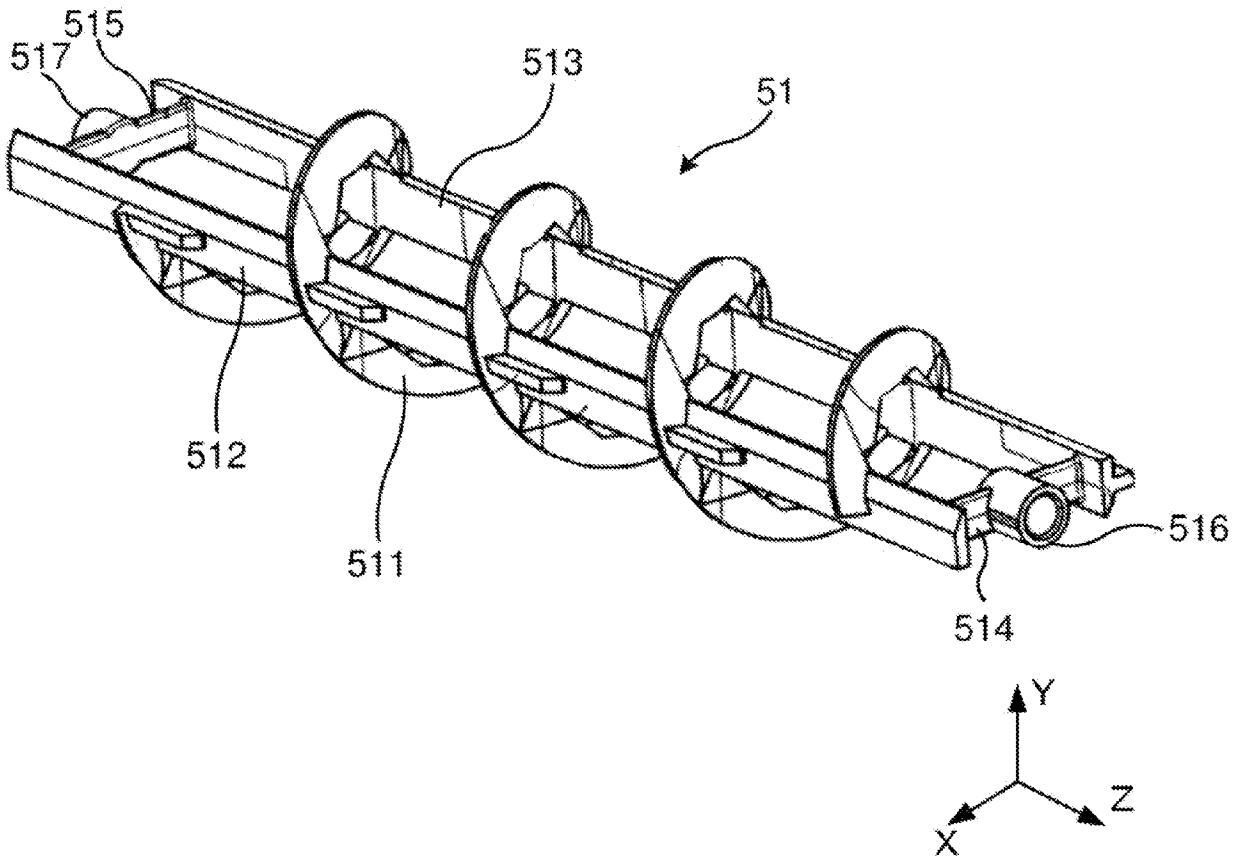
FIG. 4 obliquely illustrates a structure of a first spiral feeder of the developer conveying apparatus according to the one embodiment.

The following describes the detailed structure of the developer conveying apparatus 50 with reference to FIG. 4 in addition to FIG. 2 and FIG. 3. FIG. 4 is a perspective view illustrating the structure of the first spiral feeder 51. The first spiral feeder 51 includes a hollow spiral member 511, a first rib member 512, a second rib member 513, a first connecting portion 514, the second connecting portion 515, a first shaft portion 516, and a second shaft portion 517.

The first shaft portion 516 and the second shaft portion 517 each include a cylindrical bearing portion. Into this bearing portion, a projecting portion projected from the wall surface of the first housing portion 582 is inserted to rotatably journal the first shaft portion 516 and the second shaft portion 517 by the first housing portion 582. This forms a virtual rotation shaft of the first spiral feeder 51 between the first shaft portion 516 and the second shaft portion 517.

The hollow spiral member 511 is a member spirally run in the conveyance direction D2. That is, the hollow spiral member 511 is formed by consecutively installing a plurality of spiral pieces in the conveyance direction D2 to form the outer peripheral edge of the first spiral feeder 51. These spiral pieces form hollow spaces at the inside of the hollow spiral member 511.

The first rib member 512 and the second rib member 513 are plate-shaped members run in the conveyance direction D2. The first rib member 512 and the second rib member 513 are located to bridge the spiral pieces, which constitute the hollow spiral member 511. The first rib member 512 and the second rib member 513 are arranged so as to be separate by 180 degrees around the rotation shaft of the first spiral feeder 51. The first rib member 512 and the second rib member 513 support the hollow spiral member 511 and also have a function to stir and convey the developer housed in the first housing portion 582. At both the end portions of the first rib member 512 and the second rib member 513, regions where the hollow spiral member 511 is not arranged are present.

The first connecting portion 514 and the second connecting portion 515 are plate-shaped members connecting the end portions of the first rib member 512 and the second rib member 513. The first connecting portion 514 forms the above-described first shaft portion 516 at the center part. The second connecting portion 515 forms the above-described second shaft portion 517 at the center part.

The second spiral feeder 52 includes a hollow spiral member 521, a first rib member 522, a second rib member 523, a first connecting portion 524, a second connecting portion 525, a first shaft portion 526, and a second shaft portion 527. The structure of the second spiral feeder 52 is similar to the structure of the first spiral feeder 51, and therefore such elements will not be further elaborated here.

Here, when using a spiral feeder with a shaft portion as means for stirring and conveying the developer, the developer possibly deteriorates to increase the viscosity of the developer, thus attaching to the shaft portion. Especially, with the one-component developer that does not contain the carrier, the developer is likely to aggregate, increasing the amount of developer attaching to the shaft portion. The attachment of the developer to the shaft portion deteriorates conveying performance and stirring performance of the spiral feeder.

In this respect, with the developing device 122 according to the one embodiment, the first spiral feeder 51 and the second spiral feeder 52 are formed of the hollow spiral members 411 and 521. That is, the first spiral feeder 51 does not have a shaft portion between the first shaft portion 516 and the second shaft portion 517. The second spiral feeder 52 does not have a shaft portion between the first shaft portion 526 and the second shaft portion 527. Therefore, the developing device 122 according to the one embodiment of the disclosure has no possibility of attaching the developer to the shaft portion and deteriorating the conveying performance and the stirring performance.

Figure 5:
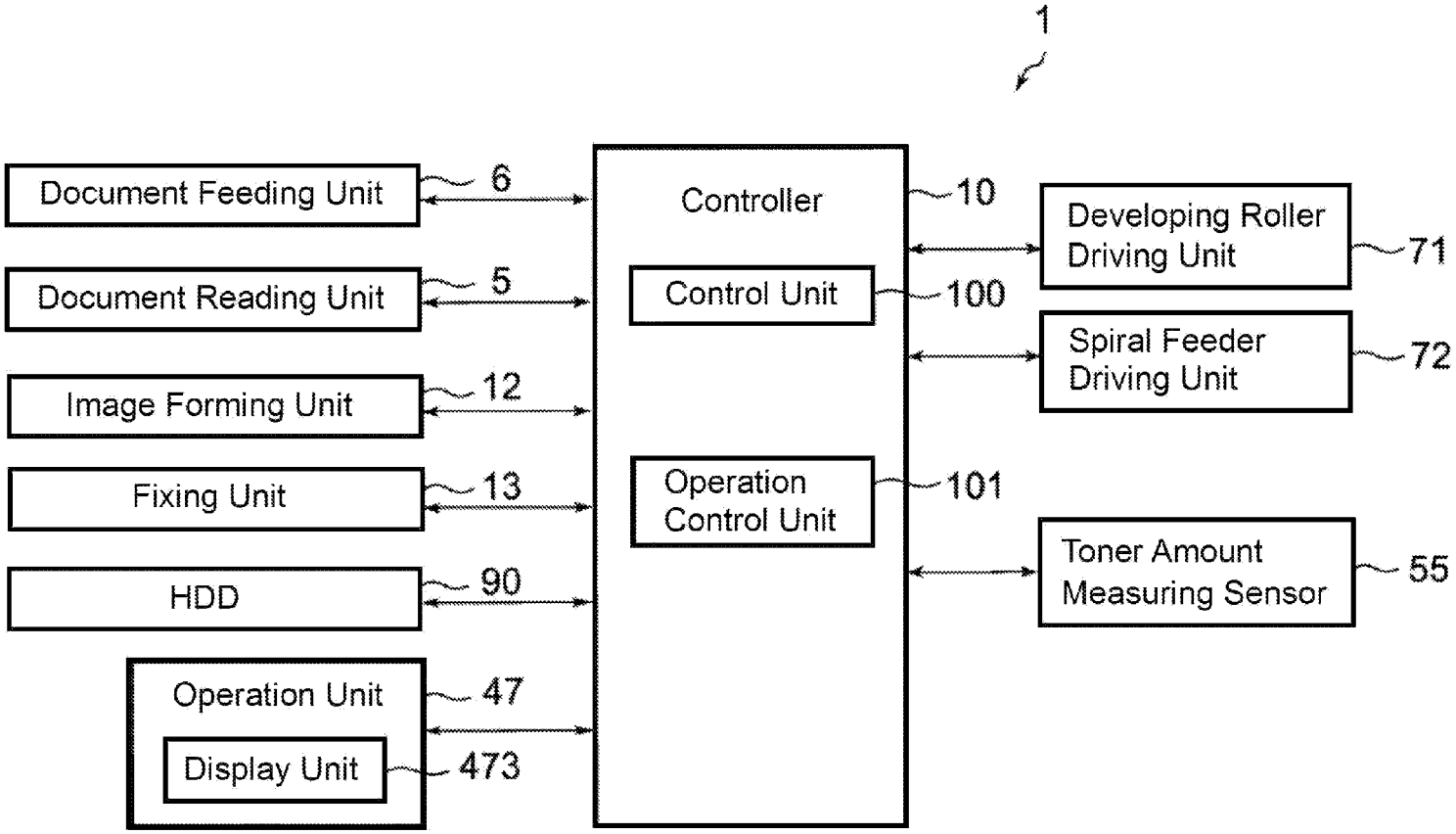
FIG. 5 schematically illustrates the main internal configuration of the image forming apparatus according to the one embodiment.

Subsequently, the following describes the internal configuration of the image forming apparatus 1. FIG. 5 is a function block diagram schematically illustrating the main internal configuration of the image forming apparatus 1.

A Hard Disk Drive (HDD) 90 is a large capacity storage device storing image data received from a computer connected to the image forming apparatus 1 over network or similar data.

The operation unit 47 includes a display unit 473. The display unit 473 includes a Liquid Crystal Display (LCD) and an Organic Light-Emitting Diode (OLED). The display unit 473 displays a screen or a similar element drawn by the operation control unit 101 of a controller 10, which will be described later.

A developing roller driving unit 71 is constituted by a motor, a gear, a screwdriver, or a similar component. The developing roller driving unit 71 functions as a driving source that gives rotary drive power to the developing roller 53.

The spiral feeder driving unit 72 is constituted by a motor, a gear, a screwdriver, or a similar component. The spiral feeder driving unit 72 functions as a driving source that gives rotary drive power to the first spiral feeder 51 and the second spiral feeder 52. Under control by the operation control unit 101, the spiral feeder driving unit 72 rotatably drives the first spiral feeder 51 and the second spiral feeder 52 at an identical rotation speed.

The image forming apparatus 1 includes the controller 10. The controller 10 is configured with a Central Processing Unit (CPU), a RAM, a ROM, an exclusive hardware circuit, and a similar component. When executing a developing device control program stored in the ROM or the HDD 90 and an image forming apparatus control on the CPU, the controller 10 functions as a control unit 100 and the operation control unit 101.

The control unit 100 manages the entire control of the developing device 122 and the image forming apparatus 1. The control unit 100 exchanges signals or data with each connected mechanism.

The operation control unit 101 has a low speed operation mode in addition to a usual operation mode. The usual operation mode controls operations of an image forming part such as the image forming units 12 and forms an image on the recording sheet P at a usual printing linear speed. The low speed operation mode reduces the printing linear speed slower than the usual operation mode and forms an image on the recording sheet P.

When decelerating the printing linear speed in the low speed operation mode, the amount of developer supplied by the developer conveying apparatus 50 needs to be reduced. In view of this, the operation control unit 101 controls the rotary drive operations by the first spiral feeder 51 and the second spiral feeder 52 by the spiral feeder driving unit 72 to decrease the rotation speed of the first spiral feeder 51 and the second spiral feeder 52.

When transitioning from the low speed operation mode to the usual operation mode to accelerate the printing linear speed, the amount of developer supplied by the developer conveying apparatus 50 needs to be increased. In view of this, the operation control unit 101 controls the rotary drive operations by the first spiral feeder 51 and the second spiral feeder 52 by the spiral feeder driving unit 72 to increase the rotation speed of the first spiral feeder 51 and the second spiral feeder 52.

When the operation control unit 101 causes the spiral feeder driving unit 72 to change the rotation speed of the first spiral feeder 51 and the second spiral feeder 52 according to the printing linear speed as described above, the operation control unit 101 also causes the spiral feeder driving unit 72 to change the rotational phase difference between the first spiral feeder 51 and the second spiral feeder 52. The HDD 90 or a similar memory preliminary stores the rotational phase difference predetermined according to the rotation speed before change and the rotation speed after change. The operation control unit 101 refers to this rotational phase difference, which is preliminary stored in the HDD 90 or a similar memory, to change the rotational phase difference between the first spiral feeder 51 and the second spiral feeder 52 to the rotational phase difference corresponding to the rotation speed after the change.

Figure 6A:
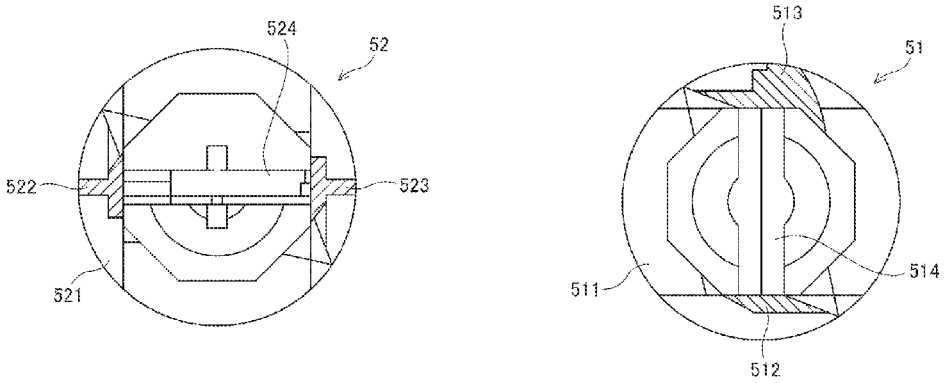
FIG. 6A is a cross-sectional view taken along the line IV-IV of the developer conveying apparatus illustrated in FIG. 3 when a rotational phase difference between the first spiral feeder and a second spiral feeder is 90 degrees according to the one embodiment.
Figure 6B:
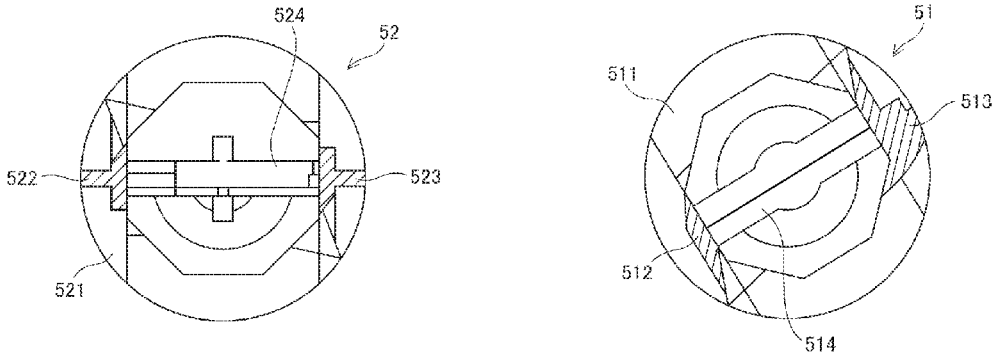
FIG. 6B is a cross-sectional view taken along the line IV-IV of the developer conveying apparatus when a rotational phase difference between the first spiral feeder and the second spiral feeder is 45 degrees according to the one embodiment.

FIG. 6A is a cross-sectional view taken along the line IV-IV of the developer conveying apparatus 50 illustrated in FIG. 3 when the rotational phase difference between the first spiral feeder 51 and the second spiral feeder 52 is 90 degrees. FIG. 6B is a cross-sectional view taken along the line IV-IV of the developer conveying apparatus 50 when the rotational phase difference between the first spiral feeder 51 and the second spiral feeder 52 is 45 degrees.

As illustrated in FIG. 6A and FIG. 6B, the rotational phase difference between the first spiral feeder 51 and the second spiral feeder 52 is a difference in angle in the rotation direction of the spiral feeders formed by rib members of the first spiral feeder 51 (the first rib member 512 and the second rib member 513) and the rib members of the second spiral feeder 52 (the first rib member 522 and the second rib member 523).

When the operation control unit 101 increases the rotation speed of the first spiral feeder 51 and the second spiral feeder 52, the operation control unit 101 causes the spiral feeder driving unit 72 to change the rotational phase difference such that the rotational phase difference between the first spiral feeder 51 and the second spiral feeder 52 after the change approaches 90 degrees more than the rotational phase difference before the change. On the other hand, when the operation control unit 101 decreases the rotation speed of the first spiral feeder 51 and the second spiral feeder 52, the operation control unit 101 causes the spiral feeder driving unit 72 to change the rotational phase difference such that the rotational phase difference between the first spiral feeder 51 and the second spiral feeder 52 after the change is away from 90 degrees more than the rotational phase difference before the change.

For example, in the usual operation mode, when the operation control unit 101 sets the rotational phase difference to 90 degrees and causes the spiral feeder driving unit 72 to rotatably drive the first spiral feeder 51 and the second spiral feeder 52 as illustrated in FIG. 6A, in the low speed operation mode, as illustrated in FIG. 6B, the operation control unit 101 causes the spiral feeder driving unit 72 to change the rotational phase difference such that the rotational phase difference after the change is away from 90 degrees (45 degrees) more than the rotational phase difference before the change (90 degrees).

Figure 7:
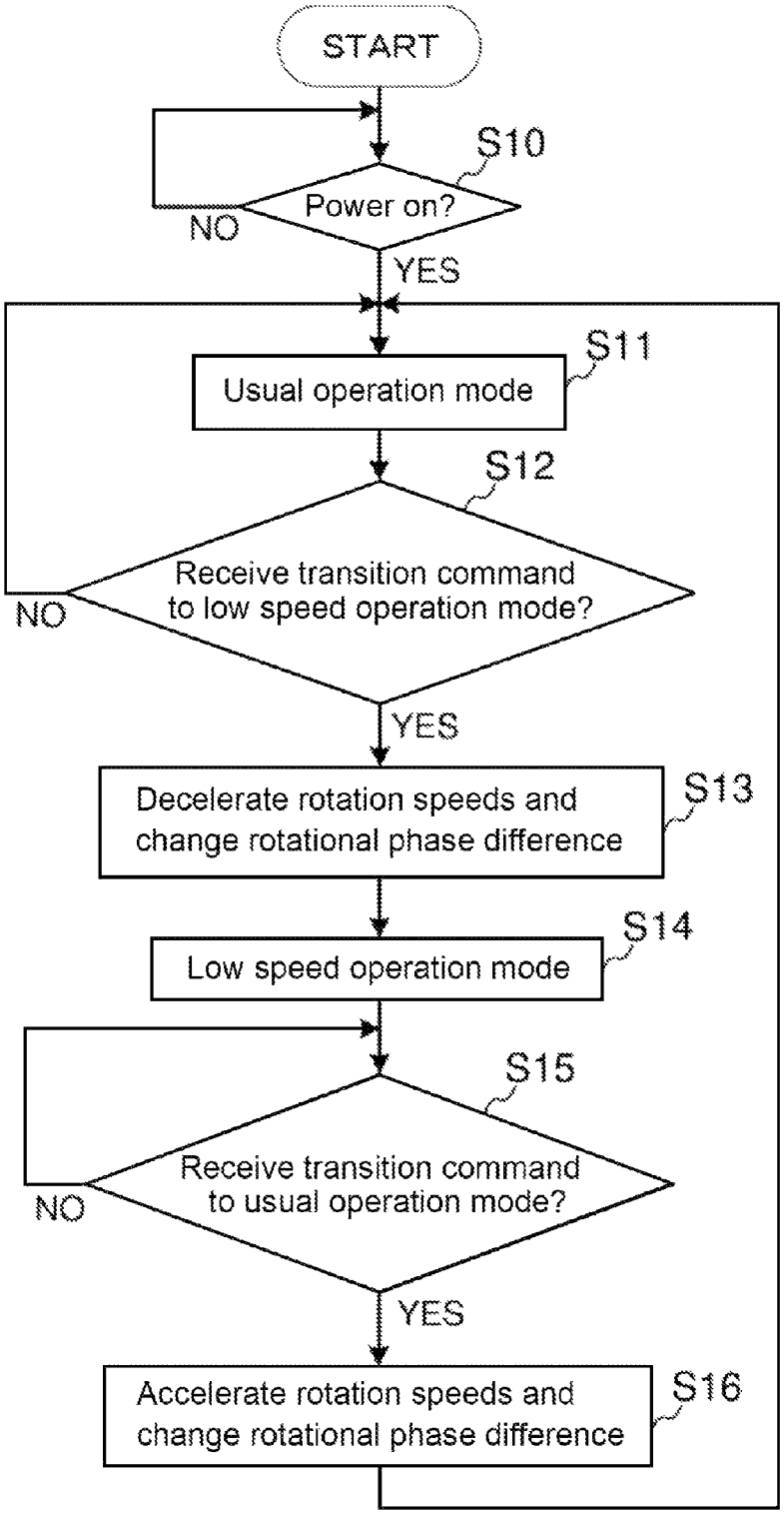
FIG. 7 illustrates a flow of operations of the developing device and the image forming apparatus according to the one embodiment.

FIG. 7 is a flowchart illustrating a flow of operations of the developing device 122 and the image forming apparatus 1.

When powering on the image forming apparatus 1 (YES at Step S10), the operation control unit 101 sets the operation mode of the image forming apparatus 1 to the usual operation mode, which forms an image on the recording sheet P at the usual printing linear speed (Step S11).

When the operation control unit 101 receives a transition command to the low speed operation mode (YES at Step S12), the operation control unit 101 causes the spiral feeder driving unit 72 to decrease the rotation speed of the first spiral feeder 51 and the second spiral feeder 52. Additionally, the operation control unit 101 causes the spiral feeder driving unit 72 to change the rotational phase difference such that the rotational phase difference after the change is away from 90 degrees more than the rotational phase difference before the change (Step S13).

Afterwards, the operation control unit 101 changes the operation mode of the image forming apparatus 1 to the low speed operation mode, which reduces the printing linear speed slower than the usual operation mode and forms an image on the recording sheet P (Step S14).

After the process of Step S14, when the operation control unit 101 accepts the transition command to the usual operation mode (YES at Step S15), the operation control unit 101 causes the spiral feeder driving unit 72 to increase the rotation speed of the first spiral feeder 51 and the second spiral feeder 52. Additionally, the operation control unit 101 causes the spiral feeder driving unit 72 to change the rotational phase difference such that the rotational phase difference after the change approaches 90 degrees more than the rotational phase difference before the change (Step S16).

The following describes effects brought by changing the rotational phase difference between the first spiral feeder 51 and the second spiral feeder 52 according to the printing linear speed as described above.

Figure 8:
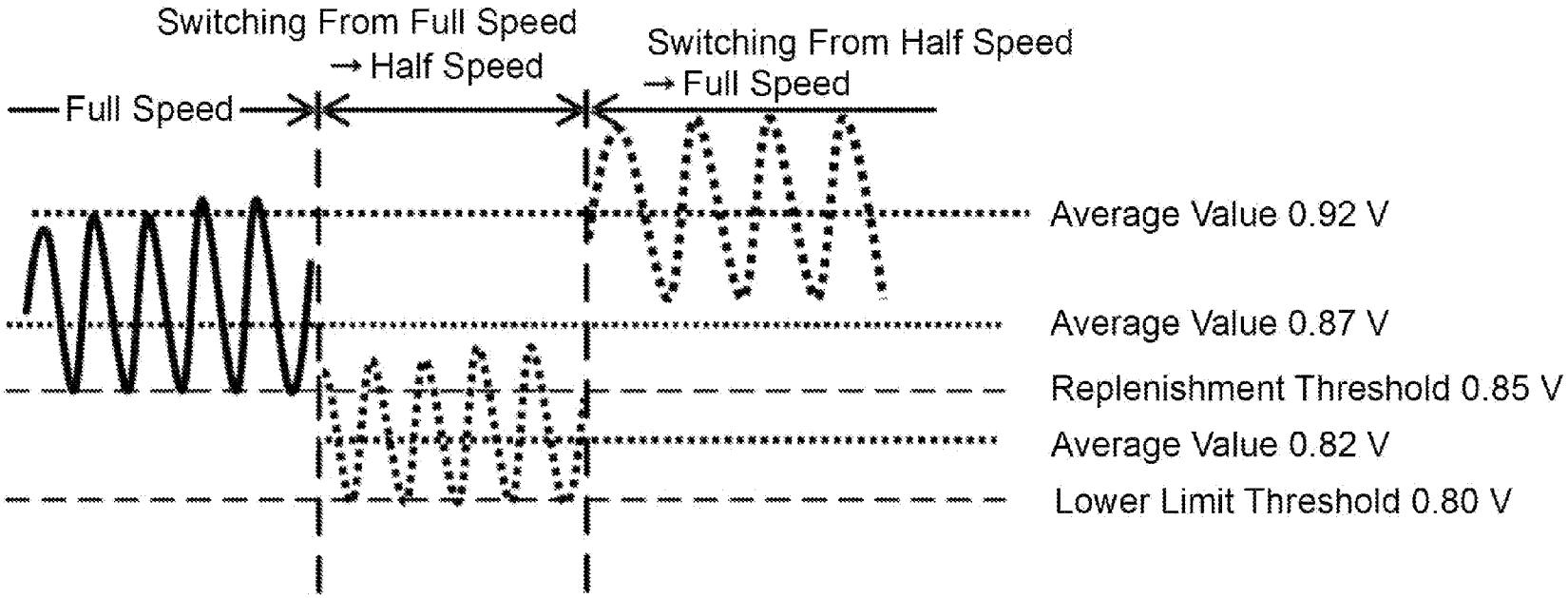
FIG. 8 illustrates a transition of output values from a toner amount measuring sensor according to the one embodiment when changing rotation speed of the first spiral feeder and the second spiral feeder according to a printing linear speed while not changing the rotational phase difference.

FIG. 8 illustrates a transition of output values from the toner amount measuring sensor 55 when changing rotation speed of the first spiral feeder 51 and the second spiral feeder 52 according to the printing linear speed but not changing the rotational phase difference. The example illustrated in FIG. 8 shows the case when switching from the printing linear speed at 410 mm/sec (full speed) in the usual operation mode to the printing linear speed at 205 mm/sec (half speed) in the low speed operation mode. FIG. 8 illustrates the case when setting both rotational phase differences between the first spiral feeder 51 and the second spiral feeder 52 in the usual operation mode and the low speed operation mode to 90 degrees.

Here, a replenishment threshold is a threshold determining a timing of replenishing the developer. When the output value from the toner amount measuring sensor 55 reaches equal to or less than the replenishment threshold (0.85 V in the example illustrated in FIG. 8), the operation control unit 101 opens the shutter, which is located at the developer replenishing port of the first housing portion 582, to replenish the developer from the developer container 59 to the first housing portion 582. A lower limit threshold is a threshold indicative of the lower limit of the amount of developer that should be housed in the housing 58. When the output value from the toner amount measuring sensor 55 reaches equal to or less than the lower limit threshold (0.80 V in the example illustrated in FIG. 8), the operation control unit 101 halts an image formation process in execution and causes the display unit 473 to display a notification screen notifying shortage of the developer.

With reference to FIG. 8, in the usual operation mode, the average value of the output values from the toner amount measuring sensor 55 is 0.87 V. Meanwhile, when switching from the usual operation mode to the low speed operation mode and therefore the rotation speeds of the first spiral feeder 51 and the second spiral feeder 52 decrease, the output value from the toner amount measuring sensor 55 reduces to near the lower limit threshold. This possibly occurs due to the following reason. Decelerating the rotation speed of the first spiral feeder 51 and the second spiral feeder 52 decreases the conveying speed of the developer in the housing 58. This reduces the pressure given to the wall surface of the first housing portion 582 by the developer.

Afterwards, when switching from the low speed operation mode to the usual operation mode, the average value of the output values from the toner amount measuring sensor 55 becomes 0.92 V. This possibly occurs due to the following reason. The reduction in the output value from the toner amount measuring sensor 55 in the low speed operation mode replenishes a large amount of developer. Thus, changing the rotation speed of the first spiral feeder 51 and the second spiral feeder 52 changes the output value output from the toner amount measuring sensor 55. In view of this, the amount of developer inside the housing 58 may fail to be kept within the appropriate range.

Figure 9:
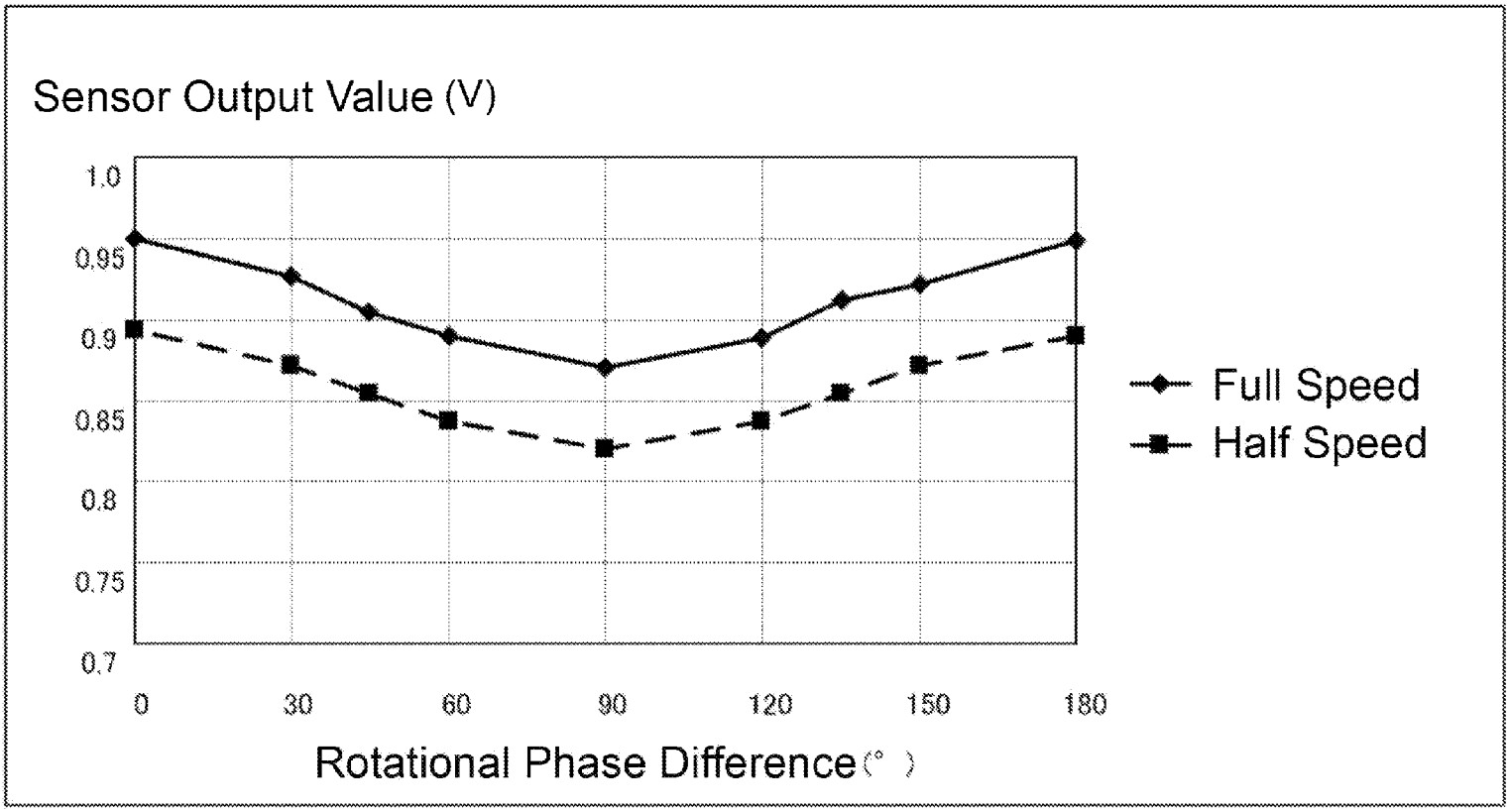
FIG. 9 illustrates the transition of the output values from the toner amount measuring sensor according to the one embodiment when changing the rotational phase difference between the first spiral feeder and the second spiral feeder.

As a result of extensive research on this problem, the disclosing party conceived that changing the rotational phase difference between the first spiral feeder 51 and the second spiral feeder 52 can reduce the change in output value from the toner amount measuring sensor 55 caused by changing the rotation speed of the first spiral feeder 51 and second spiral feeder 52. FIG. 9 illustrates the transition of the output values from the toner amount measuring sensor 55 when changing the rotational phase difference between the first spiral feeder 51 and the second spiral feeder 52. As illustrated in FIG. 9, at the rotational phase difference between the first spiral feeder 51 and the second spiral feeder 52 of 90 degrees, the output value from the toner amount measuring sensor 55 becomes the lowest. As the rotational phase difference between the first spiral feeder 51 and the second spiral feeder 52 is away from 90 degrees, the output value from the toner amount measuring sensor 55 becomes high. At the rotational phase difference between the first spiral feeder 51 and the second spiral feeder 52 of 0 degrees or 180 degrees, the output value from the toner amount measuring sensor 55 becomes the maximum.

The rib members of the first spiral feeder 51 (the first rib member 512 and the second rib member 513) and the rib members of the second spiral feeder 52 (the first rib member 522 and the second rib member 523) mainly achieve the delivery and receipt of the developer between the first housing portion 582 and the second housing portion 583 by conveying the developer. When rotating the rib members of this second spiral feeder 52 forming the angle of 90 degrees with respect to the rib members of the first spiral feeder 51, the rib members of the second spiral feeder 52 do not prevent the flow of the developer conveyed by the rib members of the first spiral feeder 51 and passes through the first communicating port 584. That is, this maximizes the delivery and reception efficiency of the developer from the first spiral feeder 51 to the second spiral feeder 52. On the other hand, as the rib members of the second spiral feeder 52 and the rib members of the first spiral feeder 51 approach to parallel, the rib members of the second spiral feeder 52 prevent the flow of the developer conveyed by the rib members of the first spiral feeder 51 and passes through the first communicating port 584. That is, this deteriorates the delivery and reception efficiency of the developer from the first spiral feeder 51 to the second spiral feeder 52. Consequently, the developer stagnates near the toner amount measuring sensor 55, and the pressure given to the wall surface of the first housing portion 582 by the developer heightens, increasing the output value from the toner amount measuring sensor 55.

Figure 10:
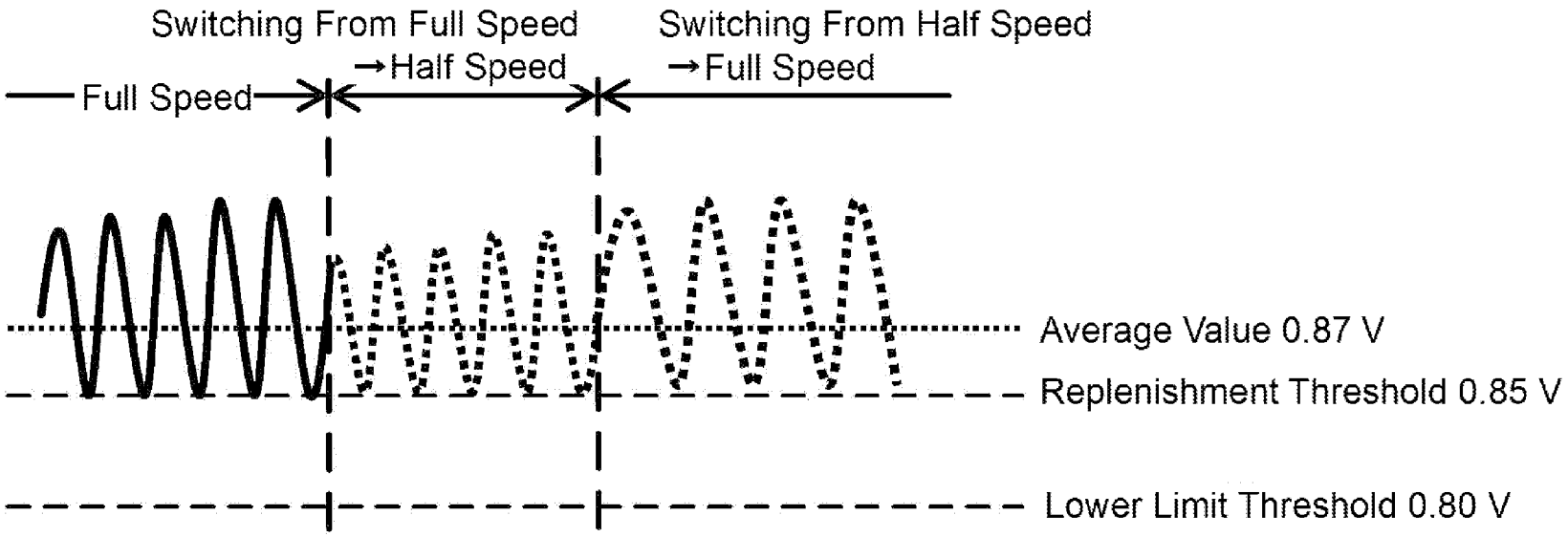
FIG. 10 illustrates the transition of the output values from the toner amount measuring sensor according to the one embodiment when changing the rotation speed of the first spiral feeder and the second spiral feeder according to a printing linear speed and changing the rotational phase difference.

FIG. 10 illustrates the transition of the output values from the toner amount measuring sensor 55 when changing the rotation speed of the first spiral feeder 51 and the second spiral feeder 52 according to the printing linear speed and changing the rotational phase difference. The example illustrated in FIG. 10 shows the case when switching from the printing linear speed at 410 mm/sec (full speed) in the usual operation mode to the printing linear speed at 205 mm/sec (half speed) in the low speed operation mode. FIG. 10 illustrates the case when setting the rotational phase difference between the first spiral feeder 51 and the second spiral feeder 52 in the usual operation mode to 90 degrees while setting the rotational phase difference between the first spiral feeder 51 and the second spiral feeder 52 in the low speed operation mode to 45 degrees.

With reference to FIG. 10, setting the rotational phase difference as described above makes the average value of the output value from the toner amount measuring sensor 55 in the usual operation mode and the average value of the output value from the toner amount measuring sensor 55 in the low speed operation mode identical, 0.87 V. Thus, even when changing the rotation speed of the first spiral feeder 51 and the second spiral feeder 52, which stir the developer according to the change in the printing linear speed, changing the rotational phase difference between the first spiral feeder 51 and the second spiral feeder 52 ensures measuring the amount of developer in the housing 58 without any change from before the change. Additionally, since the timing of replenishing the developer does not change due to the change in the printing linear speed, ensuring keeping the amount of developer in the housing 58 within the appropriate range.

Figure 11:
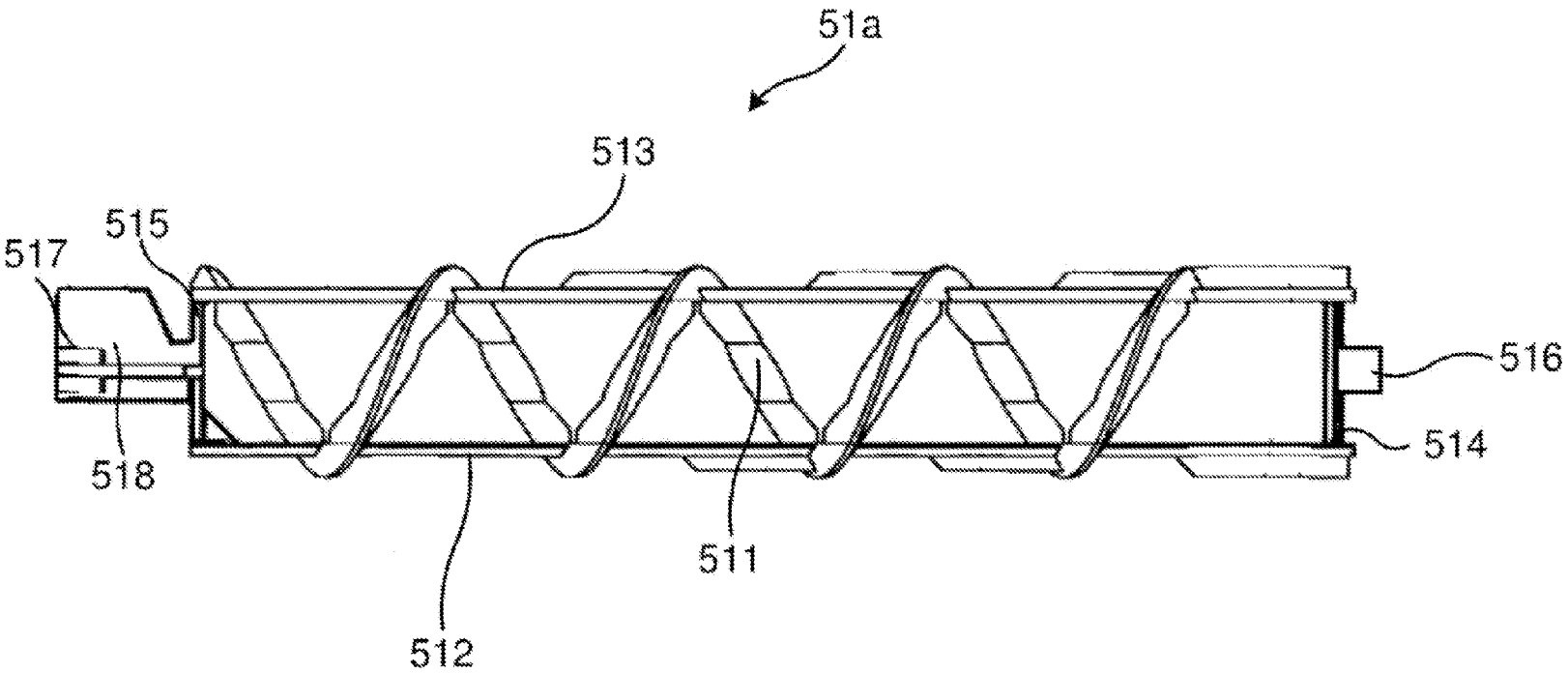
FIG. 11 illustrates a structure of a first spiral feeder according to a modification.

FIG. 11 illustrates a structure of a first spiral feeder 51*a* according to a modification. With the first spiral feeder 51*a*, the identical reference numerals are assigned to the configurations identical to the first spiral feeder illustrated in FIG. 4. The first spiral feeder 51*a* according to the modification is provided with a flat-plate shaped paddle 518 at the one end portion. When locating the first spiral feeder 51*a* in the first housing portion 582, the paddle 518 positions at a region opposed to the first communicating port 584. The paddle 518 is integrally formed with the second connecting portion 515, which connects the first rib member 512 and the second rib member 513. The paddle 518 rotates along with both the first rib member 512 and the second rib member 513 to move the developer from the first housing portion 582 to the second housing portion 583.

Thus, the first spiral feeder 51*a* according to the modification includes the paddle 518 as a member to move the developer from the first housing portion 582 to the second housing portion 583 in addition to the first rib member 512 and the second rib member 513, ensuring improving the conveying speed of the developer. The above-described paddle may be located at the second spiral feeder 52.

The embodiment describes the case where the housing 58 houses the one-component developer containing the magnetic toner and the development is performed using this one-component developer. However, the disclosure is not limited to this case. The housing 58 may house a two-component developer containing toner and a magnetic carrier to perform the development using this two-component developer.

The embodiment describes the case when arranging the two rib members at the spiral feeder; however, the disclosure is not limited to this case. Three or more rib members may be arranged providing regular intervals in the rotation direction of the spiral feeders.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A developer conveying apparatus comprising:

a developer housing portion that includes a first housing portion and a second housing portion housing a developer, the developer housing portion forming communicating ports at both end portions in a longitudinal direction of a partition wall partitioning the first housing portion and the second housing portion, the developer being movable between the first housing portion and the second housing portion through the communicating ports;

a first spiral feeder rotatably located in the first housing portion, the first spiral feeder conveying the developer housed in the first housing portion in a first direction along the longitudinal direction;

a second spiral feeder rotatably located in the second housing portion, the second spiral feeder conveying the developer housed in the second housing portion in a second direction opposite direction from the first direction;

a driving unit that rotatably drives the first spiral feeder and the second spiral feeder at an identical rotation speed;

an operation control unit that controls a rotary drive operation by the driving unit; and a sensor located at a periphery position of the communicating port in the developer housing portion to measure a toner amount of the developer housed in the developer housing portion; wherein the first spiral feeder and the second spiral feeder each include a hollow spiral member and rib members, the hollow spiral member being spirally formed and internally having a space, the rib members running in the first direction and bridging spiral pieces constituting the spiral member; and the operation control unit:

causes the driving unit to change the rotation speed of the first spiral feeder and the second spiral feeder according to a printing linear speed of an image forming part, the image forming part being a supply destination of the developer housed in the developer housing portion; and causes the driving unit to change a rotational phase difference between the first spiral feeder and the second spiral feeder referring positions of the rib members to a predetermined rotational phase difference according to the changed rotation speed.

2. The developer conveying apparatus according to claim 1, wherein a plurality of the rib members are arranged providing regular intervals in rotation directions of the first spiral feeder and the second spiral feeder.

3. The developer conveying apparatus according to claim 2, wherein the operation control unit:

causes the driving unit to change the rotational phase difference to make the rotational phase difference after the change closer to 90 degrees than the rotational phase difference before the change when increasing the rotation speed of the first spiral feeder and the second spiral feeder, in a case of arranging the two rib members providing regular intervals; and causes the driving unit to change the rotational phase difference to make the rotational phase difference after the change further away from 90 degrees than the rotational phase difference before the change, when decreasing the rotation speed of the first spiral feeder and the second spiral feeder.

4. The developer conveying apparatus according to claim 1, wherein the operation control unit:

causes the driving unit to increase the rotation speed of the first spiral feeder and the second spiral feeder, as a printing linear speed of the image forming part increases; and causes the driving unit to decrease the rotation speed of the first spiral feeder and the second spiral feeder, as the printing linear speed of the image forming part decreases.

5. The developer conveying apparatus according to claim 1, further comprising a paddle located at each of a downstream end of the first spiral feeder in the first direction and a downstream end of the second spiral feeder in the second direction, the paddle moving the developer to the communicating port.

6. The developer conveying apparatus according to claim 1, wherein the developer housed in the developer housing portion is single-component toner.

7. A developing device, comprising:

the developer conveying apparatus according to claim 1; and a developer carrier that carries a developer conveyed by the developer conveying apparatus.

8. An image forming apparatus, comprising:

the developing device according to claim 7; and an image carrier arranged opposed to the developer carrier.

* * * * *